US005941155A

United States Patent [19]

Arai et al.

[11] Patent Number: 5,941,155

[45] Date of Patent: Aug. 24, 1999

[54] HYDRAULIC MOTOR CONTROL SYSTEM

[75] Inventors: Seigo Arai; Susumu Ohmori, both of Hiroshima; Naoki Sugano, Kobe, all of Japan

[73] Assignee: Kabushiki Kaisha Kobe Seiko Sho, Kobe, Japan

[21] Appl. No.: 08/972,133

[22] Filed: Nov. 17, 1997

[30] Foreign Application Priority Data

Nov. 20, 1996 [JP] Japan ..... 8-309684
Jul. 14, 1997 [JP] Japan ..... 9-188576

[51] Int. Cl.[6] ..... F15B 11/04

[52] U.S. Cl. ..... 91/38; 91/35; 60/468

[58] Field of Search ..... 91/38, 35, 444; 60/468

[56] References Cited

U.S. PATENT DOCUMENTS

| | | | |
|---|---|---|---|
| 4,481,770 | 11/1984 | Lohbauer et al. | 91/442 |
| 4,694,649 | 9/1987 | Howeth | 60/468 |
| 5,025,626 | 6/1991 | Crosser et al. | 60/468 |
| 5,050,483 | 9/1991 | Yoshikawa et al. | 60/468 |
| 5,680,760 | 10/1997 | Lunzman | 60/468 |

FOREIGN PATENT DOCUMENTS

| | | |
|---|---|---|
| 0 708 250 | 4/1996 | European Pat. Off. . |
| 0 816576 | 1/1998 | European Pat. Off. . |
| 4-203506 | 7/1992 | Japan . |
| 7-19203 | 1/1995 | Japan . |
| WO97/45659 | 12/1997 | WIPO . |

OTHER PUBLICATIONS

Patent Abstracts of Japan, vol. 014, No. 424, Sep. 12, 1990, JP 02 168002 (Jun. 28, 1990).

*Primary Examiner*—Sheldon J. Richter
*Attorney, Agent, or Firm*—Oblon, Spivak, McClelland, Maier & Neustadt, P.C.

[57] ABSTRACT

A flow control valve is disposed in a bleed-off line which is for returning to a tank a portion of an oil flow advancing toward a hydraulic motor from a hydraulic pump. Upon operation of a control valve in an accelerating direction, the flow control valve is operated in a closing direction with a certain time lag, while upon operation of the control valve in a decelerating direction, the flow control valve is operated in an opening direction without a time lag. By so doing, an accelerating operation can be done smoothly while maintaining a required torque.

14 Claims, 15 Drawing Sheets

HYDRAULIC MOTOR CONTROL SYSTEM

BACKGROUND OF THE INVENTION

1. Field of the Invention

The present invention relates to a hydraulic motor control system for controlling a hydraulic motor such as a rotating motor or a traveling motor used in a hydraulic working machine such as a hydraulic excavator or a hydraulic crane.

2. Description of the Related Art

A rotating motor used in a conventional hydraulic excavator or hydraulic crane will now be described. FIG. 22 illustrates a circuit for a rotating motor in a conventional hydraulic excavator. In the same figure, the numeral 1 denotes a rotating motor, the numeral 2 denotes a hydraulic pump as an oil pressure source for the motor 1, the numeral 3 denotes an engine for driving the pump 2, the numeral 4 denotes a hydraulic pilot change-over type control valve for controlling the operation of the motor 1, and the numeral 5 denotes a remote control valve (the numeral 5*a* denotes an operating lever). A pilot pressure proportional to the amount of operation of the lever in the remote control valve 5 is fed to a pilot port of the control valve 4 to control the valve 4. As known well, the control valve 4 has meter-in, meter-out and bleed-off passages. The opening area of each of these passages varies in proportion to a spool stroke to change the flow rates for meter-in, meter-out and bleed-off, whereby the acceleration or deceleration (rotating torque) of the rotating motor 1 changes. The numeral 6 denotes a relief valve and the numeral 7 denotes an auxiliary hydraulic pump for supplying a primary pressure to the remote control valve 5.

In a hydraulic excavator, the moment of inertia varies greatly according to the posture of front attachments (boom, arm and bucket) or an excavating load imposed thereon. If the valve characteristics of the control valve 4 are set on the basis of a large moment of inertia, the rotating torque will become too large at a small moment of inertia, thus causing a fear of sudden acceleration. Besides, the operability is deteriorated, and a sudden acceleration acts also on the operator operating in the cabin, thus exerting a bad influence on the operation of the lever. The resulting vibratory operation of the lever is likely to induce a hunting phenomenon. On the other hand, the above problem can be avoided if valve characteristics are set on the basis of a small moment of inertia. However, the rotating torque becomes too small, resulting in that the excavating work or a pushing or leveling work using a rotating force is impeded.

In the conventional hydraulic excavator, the moment of inertia and the rotating torque are not well balanced, so that a certain moment of inertia causes a state of excessive torque or insufficient torque. Such a problem is not limited to the rotating motor. As to the traveling motor, almost the same problem has occurred heretofore.

SUMMARY OF THE INVENTION

It is an object of the present invention to provide a hydraulic motor control system capable of causing an accelerating operation to be performed smoothly while maintaining a required torque.

The hydraulic motor control system according to the present invention comprises a hydraulic motor, a hydraulic pump for supplying an oil pressure to the hydraulic motor, a control valve for controlling the operation of the hydraulic motor in accordance with a command from operating means, and a flow control valve disposed in a line for bypassing to a tank a portion of flow advancing toward the hydraulic motor. The flow control valve operates with a time lag for the motion of the control valve to prevent a sudden accelerating operation of the hydraulic motor. According to the present invention, not only a sudden accelerating operation at a small moment of inertia, but also it is possible to suppress hunting.

In the present invention, the flow control valve is provided in a bleed-off line which is for bypassing a portion of flow advancing toward the hydraulic motor to a tank through the control valve. Valve control means is controlled interlockedly with operation of the control valve so as to give a minimum opening area at a full stroke of the control valve and a maximum opening area at a neutral state of the valve. In the closing direction in which the opening area becomes small, the valve control means may be operated with a time lag for the motion of the control valve.

In this case, if the control valve is operated in the accelerating direction, the flow control valve closes with a certain time lag, so that the maximum speed is ensured while maintaining a required torque and then a sudden accelerating operation at a small moment of inertia is prevented. Even in the case where the operating means is operated in a vibratory manner to provide a sine wave-like input, the variation of the pump pressure is diminished and hunting is suppressed because the flow control valve has a time lag for a command signal acting in the closing direction.

In the opening direction in which the opening area becomes large, the valve control means may be operated without a time lag for the motion of the control valve. In this case, when the control valve is operated in the decelerating direction, the flow control valve operates in the opening direction without a time lag, so that at the time of turning-off operation there is no fear of an abnormal increase of the pump pressure due to full closing of the bleed-off line.

The present invention may be applied to a hydraulic circuit having a confluent line for joining the oil discharged from the hydraulic pump to the oil fed from another hydraulic pump to another hydraulic actuator. In this case, it is preferable that the flow control valve be operated in the cloing direction without a time lag By so doing, there no longer is any loss of the joined flow because the flow control valve cloes without a time lag at the time of joining of the oils.

The valve control means used in the present invention can be accomplished also by a hydraulic control using a restrictor or a check valve or even by an electric control in which an electromagnetic proportional valve is controlled with a controller.

It is preferable that the degree of time lag of the flow control valve be made variable according to the number of revolutions of the engine which is a drive source for the hydraulic pump. In this case, since the degree of time lag is variable according to the number of revolutions of the engine, the rotating pressure can be increased rapidly to prevent the delay of the accelerating time by setting small the degree of time lag in the case where the engine revolutions are small and the amount of oil discharged from the pump is small.

The opening area characteristic of the flow control valve may be made variable according to the number of revolutions of the engine as a drive source for the hydraulic pump. In this case, the acceleratability can be improved by making the opening area small at small engine revolutions, because the opening area characteristic of the flow control valve is variable according to engine revolutions.

In the present invention, moreover, a modification may be made so that the flow control valve is disposed in a bleed-off line for bypassing a portion of flow advancing toward the hydraulic motor to a tank ahead of the control valve and so that when the amount of operation of the operating means is small, the flow control valve is operated without a time lag for the operation of the control valve, while when the amount of operation of the operating means is large, the flow control valve is operated with a time lag for the operation of the valve.

The degree of time lag of the flow control valve may be made variable according to the number of revolutions of the engine as a drive source for the hydraulic pump. Further, the range in which the flow control valve is operated without a time lag for the operation of the control valve may be made variable according to the number of revolutions of the engine as a drive source for the hydraulic pump.

DESCRIPTION OF THE PREFERRED EMBODIMENTS

Control systems for a rotating motor embodying the present invention will be described hereinunder with reference to FIGS. 1 to 21.

First Embodiment (FIGS. 1~7)

Figure 1:
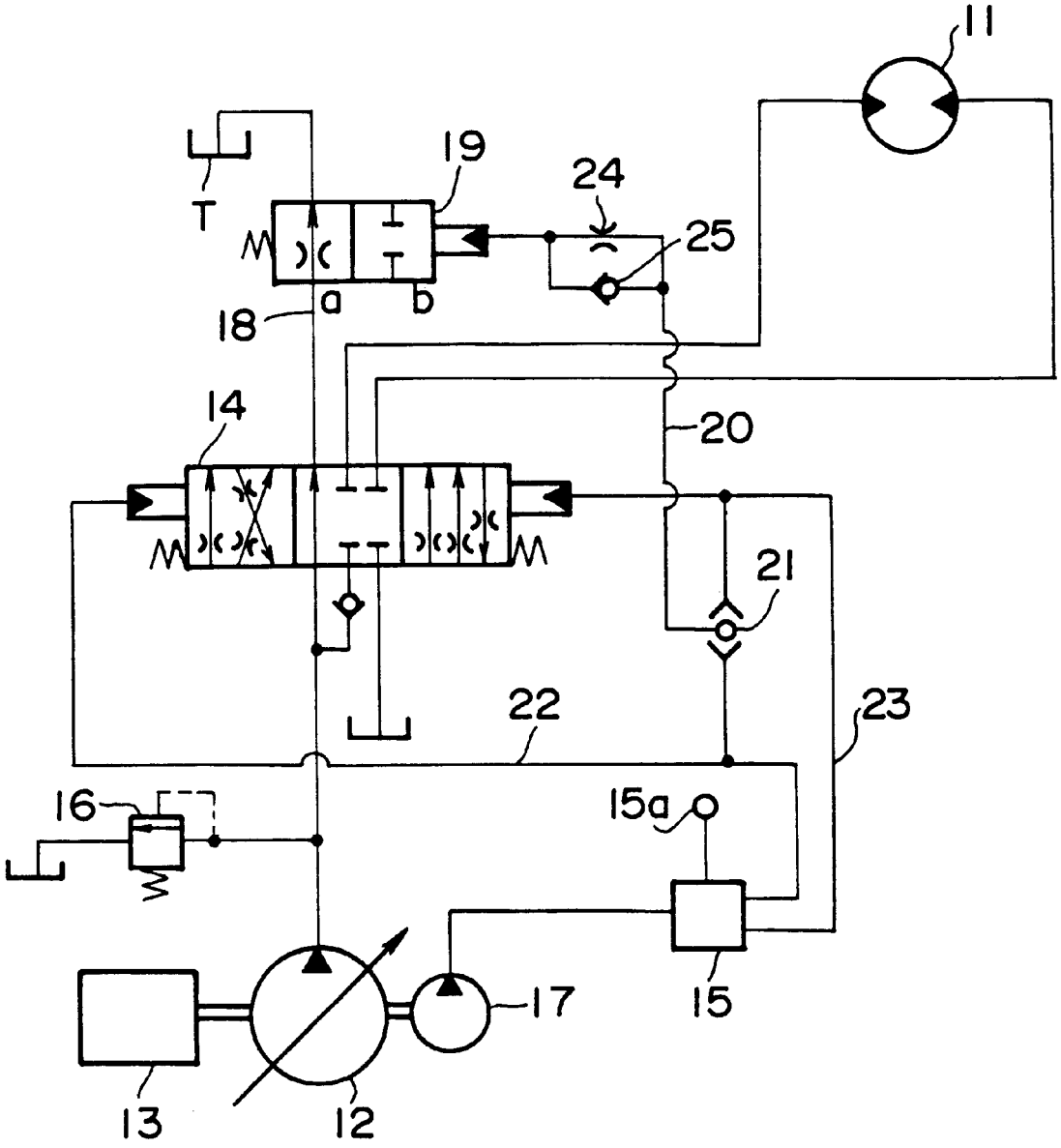
FIG. 1 is a circuit diagram of a control system according to the first embodiment of the present invention.

In FIG. 1, the numeral 11 denotes a rotating motor, the numeral 12 denotes a hydraulic pump, the numeral 13 denotes an engine for driving the pump 12, the numeral 14 denotes a control valve of a hydraulic pilot change-over type for controlling the operation of the rotating motor 11, the numeral 15 denotes a remote control valve, numeral 15*a* denotes an operating lever (operating means) of the remote control valve 15, the numeral 16 denotes a relief valve, and the numeral 17 denotes an auxiliary hydraulic pump as a primary pressure supply source for the remote control valve 15.

Figure 2:
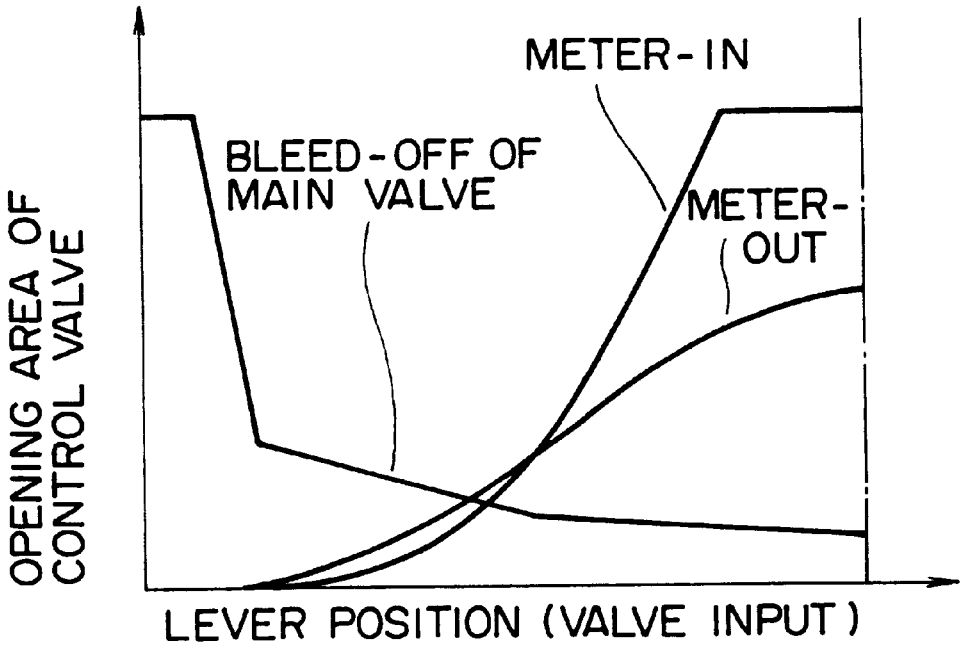
FIG. 2 is a graph showing a relation between the position of a lever and an opening area of a control valve in the control system of the first embodiment.

The position of the lever of the control valve 14 and opening area characteristics are related to each other as in FIG. 2. In a neutral position, both meter-in and meter-out opening areas are minimum and a bleed-off opening area becomes maximum. As the stroke increases, both meter-in and meter-out opening areas increase, while the bleed-off opening area becomes smaller. Even in a state of full stroke, the bleed-off passage is kept open. Thus, even in a full stroke condition the bleed-off passage does not assume a fully closed state and a constant bleed-off flow is ensured. The bleed-off opening area (minimum opening area) in a full stroke state is set to a magnitude which permits the generation of a maximum torque (pressure) in a low-speed (or OFF) condition of the motor.

Figure 3:
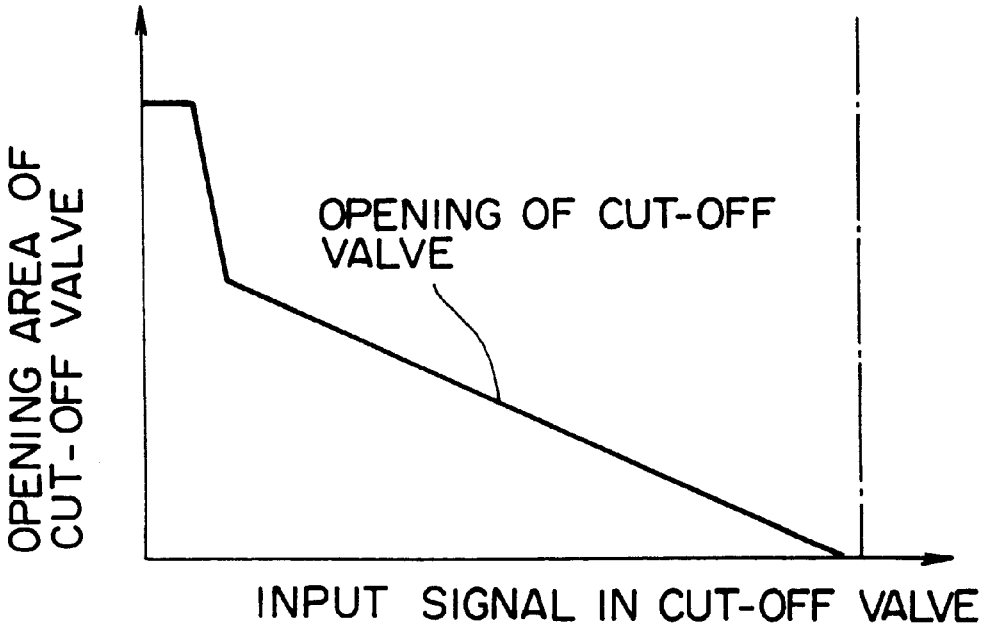
FIG. 3 is a graph showing a relation between an input signal in a cut-off valve (a flow control valve) and an opening area of the cut-off valve in the control system of the first embodiment.

A bleed-off line 18 for bypassing to a tank T a portion of the flow advancing toward the rotating motor 11 is connected to an outlet side of a bleed-off passage of the control valve 14. In the bleed-off line 18 is provided a flow control valve ("cut-off valve" hereinafter) 19 of a hydraulic pilot type. The cut-off valve 19 has a fully open position "a" and a fully closed position "b," and upon input of a pilot pressure, it operates between both positions with such a characteristic as shown in FIG. 3.

A pilot circuit 20 for conducting a pilot pressure to the cut-off valve 19 is connected through a shuttle valve (a high pressure selecting valve) 21 to pilot lines 22 and 23 extending on both sides of the control valve 14. When the control valve 14 is operated by operation of the remote control valve 15, the cut-off valve 19 operates in its closing direction under the action of a pilot pressure in the pilot lines 22 and 23.

Figure 4:
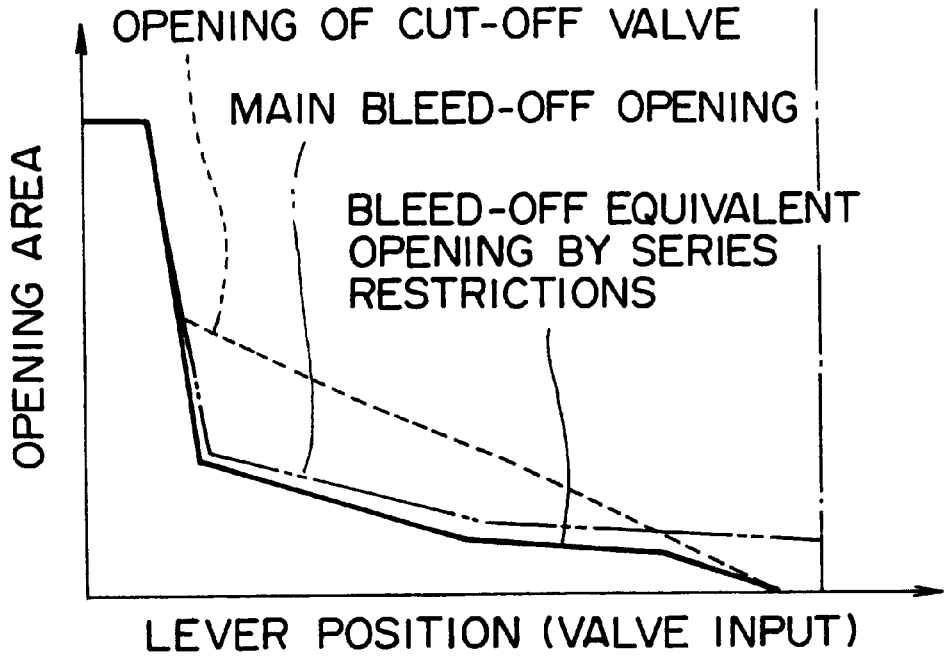
FIG. 4 is a graph showing a relation between a lever position and opening area characteristic of a bleed-off line in the control system of the first embodiment.

A parallel circuit comprising a restrictor 24 and a check valve 25, as valve control means, is connected to the pilot circuit 20. According to this circuit configuration, when the control valve 14 is operated in an accelerating direction, the cut-off valve 19 operates in its closing direction with a time lag of a certain time relative to the control valve 14 under the action of the restrictor 24. On the other hand, when the control valve 14 is operated in a decelerating direction, the pilot oil in the cut-off valve 19 flows out through the check valve 25, so that the cut-off valve 19 operates in its opening direction without a time lag. A bleed-off opening characteristic (a bleed-off equivalent opening characteristic based on series restrictions) as a combination of the bleed-off opening (main bleed-off opening) of the control valve 14 and the cut-off valve opening is as shown in FIG. 4.

The operation of the control system according to this first embodiment will now be described. If the control valve is operated at a stretch from an OFF state of the motor to a full stroke operation, the meter-in pressure rises at a stretch up to a relief pressure and this relief state continues until the rotating motor comes to have a certain speed. Assuming that the pump flow is constant, the relief pressure keeping time has a bearing on the bleed-off opening area in the full-stroke operation and the moment of inertia based on, for example, the posture of the front attachments.

Figure 5:
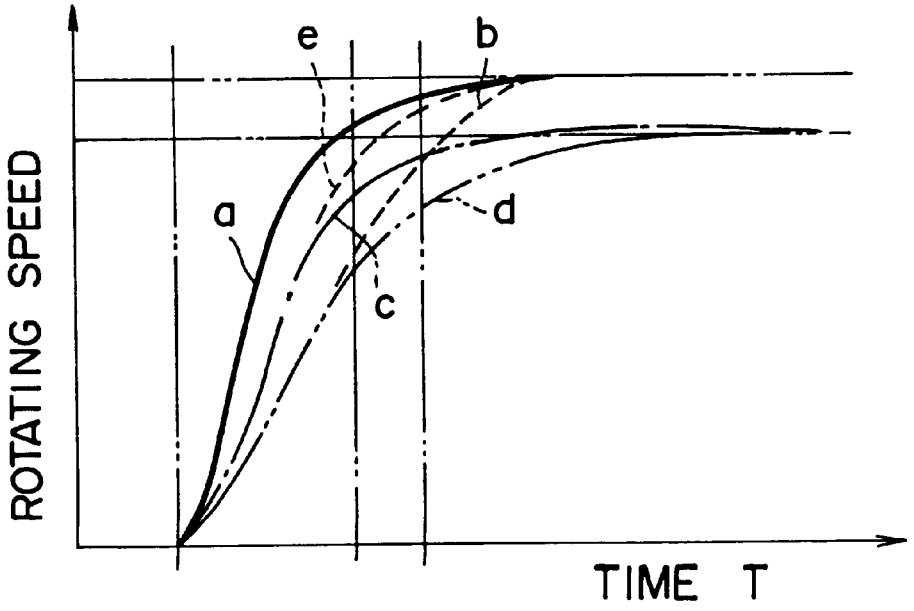
FIG. 5 is a graph showing a time-rotating speed relation for explaining the operation of the control system of the first embodiment.
Figure 6:
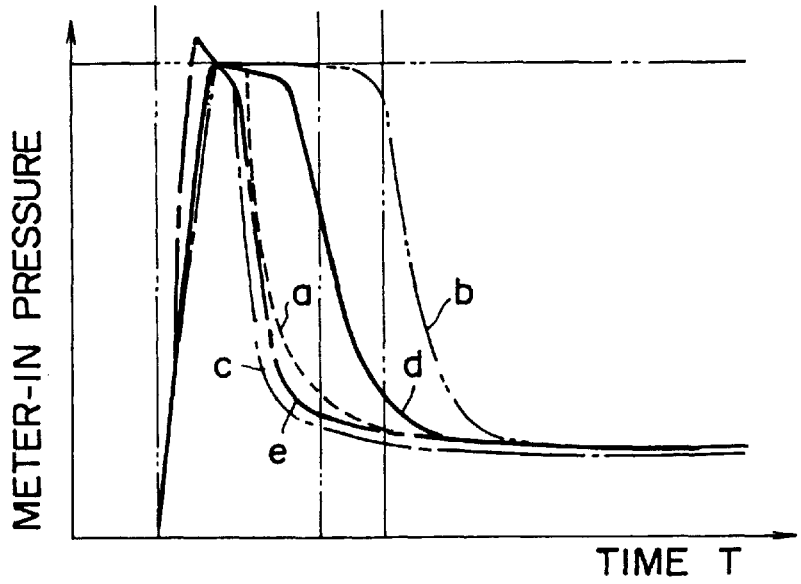
FIG. 6 is a graph showing time vs. meter-in pressure for explaining the operation of the control system of the first embodiment.

This operation is shown in both FIG. 5 (a time/rotating speed characteristic determined by the moment of inertia and the state of bleed-off opening) and FIG. 6 (likewise a time/meter-in pressure characteristic). In both figures, the reference marks a to e represent the following characteristics:

a: characteristic at a minimum inertia moment in fully cloed bleed-off b: characteristic at a maximum inertia moment in fully cloed bleed-off c: characteristic at a minimum inertia moment in slightly opened bleed-off d: characteristic at a maximum inertia moment in slightly opened bleed-off e: characteristic at a minimum inertia moment in this system as a combination of the above characteristics c and a As is seen from both figures, if the bleed-off opening is set to a slightly opened state, the maximum speed becomes low and the time (acceleration time) required until reaching the maximum speed becomes long as compared with the case where the bleed-off opening is set to a fully cloed state. Even at the same bleed-off opening, the larger the moment of inertia, the longer the time required until reaching the maximum speed.

According to the control system of this first embodiment, since the bleed-off opening is not fully cloed, the characteristics c and d are used as basic characteristics. However, since the cut-off valve 19 is gradually cloed with a time lag for the motion of the control valve 14, a shift is made from the characteristic c to a at the minimum moment of inertia, (exhibiting the characteristic e as a combination of c and a), while at the maximum moment of inertia a shift is made from d to b. Thus, at both minimum and maximum inertia moments the maximum speed and torque are reached at almost the same required time as in the fully cloed state of the bleed-off opening.

Therefore, there is neither a fear of sudden acceleration due to an excessive torque at a small inertia moment nor a fear of such a sudden acceleration exerting a bad influence on the operation of the lever by the operator. There is no fear, either, that the insufficiency of torque at a large inertia moment may cause an obstacle to the excavating work or a work which utilizes rotation such as a pushing or leveling work. During control for turning OFF (deceleration), the opening area of the cut-off valve 19 returns without a time lag up to the position corresponding to the lever position to ensure the bleed-off opening and hence there does not occur such an inconvenience as an abnormal increase of the pump pressure.

Figure 7:
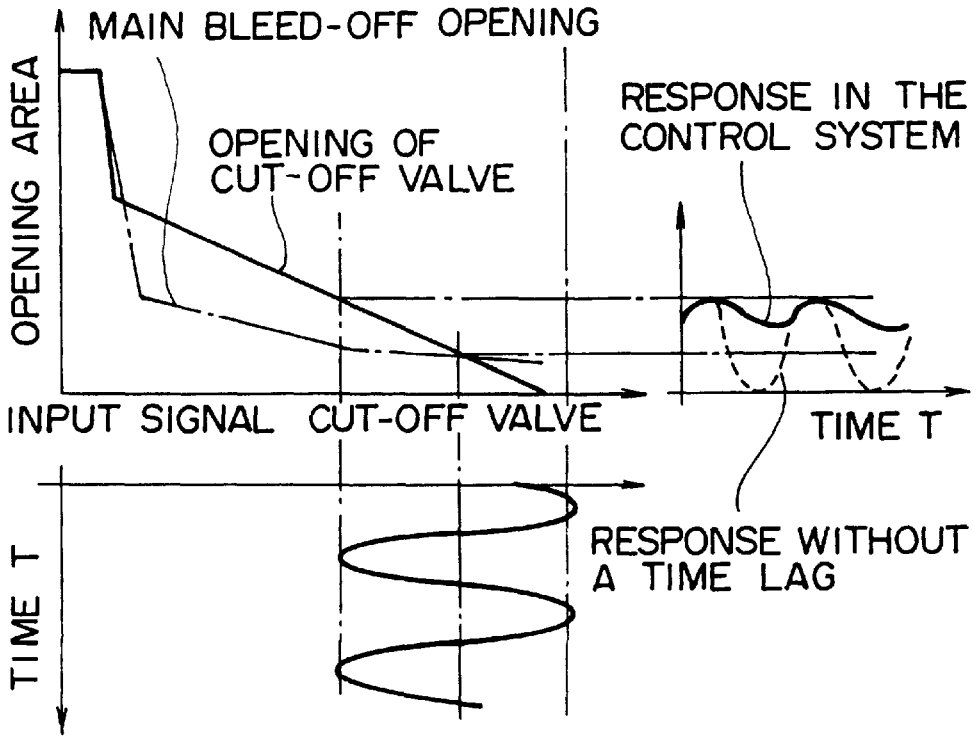
FIG. 7 is a graph showing a relation between a cut-off valve input signal and an opening area of the valve, a relation between a cut-off valve input signal and time, and a relation between time and an opening area of the valve, for explaining the operation of the control system of the first embodiment.

In the case where the operator has operated the remote control valve 15 in a vibratory manner for some reason or other, causing a sinusoidal input, there is also attained a hunting suppressing effect as shown in FIG. 7. More specifically, when there is a sinusoidal input, the state of bleed-off opening of the control valve 14 varies at a nearly 1:1 ratio to the operation of the lever, but within the delay time of the cut-off valve 19 a sufficiently large bleed-off opening is ensured by a combined bleed-off opening of both control valve 14 and cut-off valve 19. Consequently, a change of the pump pressure is difficult to occur and hunting is suppressed.

Second Embodiment (FIGS. 8~11)

A control system according to the second embodiment of the present invention will be described below, in which the same portions as in the first embodiment are indicated by the same reference numerals to omit overlapped explanations.

Figure 8:
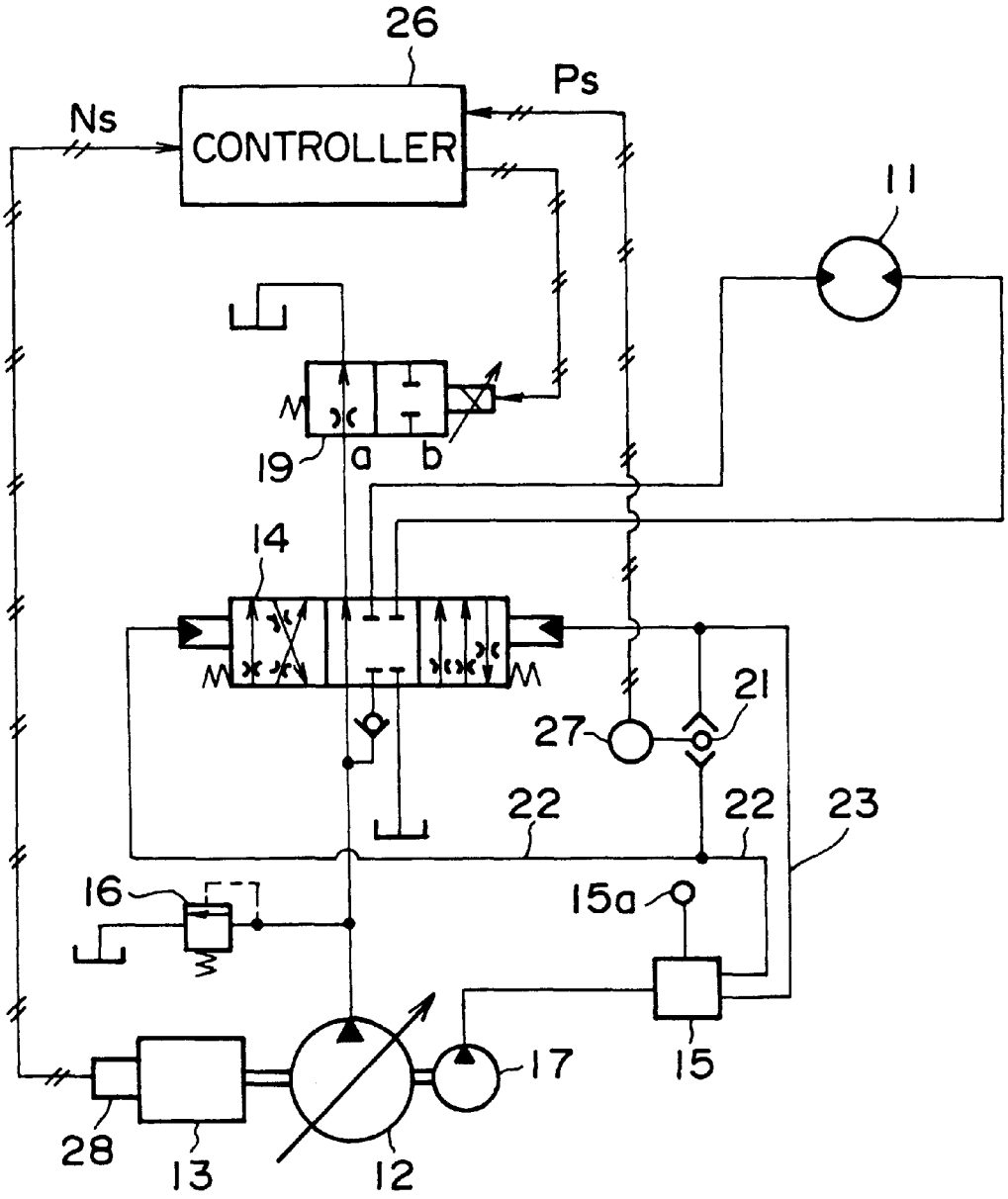
FIG. 8 is a circuit diagram of a control system according to the second embodiment of the present invention.

In the second embodiment an electromagnetic proportional valve is used as a cut-off valve 19. The cut-off valve 19 is controlled by a controller 26 having a first-order lag processing function. The degree of first-order lag of the cut-off valve 19 can be varied according to the number of revolutions of the engine. As shown in FIG. 8, as sensors there are provided a pressure sensor 27 for detecting a pilot pressure of a control valve 14 (manipulated variable of the control valve 15=command signal) through a shuttle valve 21 and an engine revolution sensor 28 for detecting the number of revolutions of the engine 13. Signals Ps and Ns from both sensors 27 and 28 are inputted to the controller 26.

Figure 9:
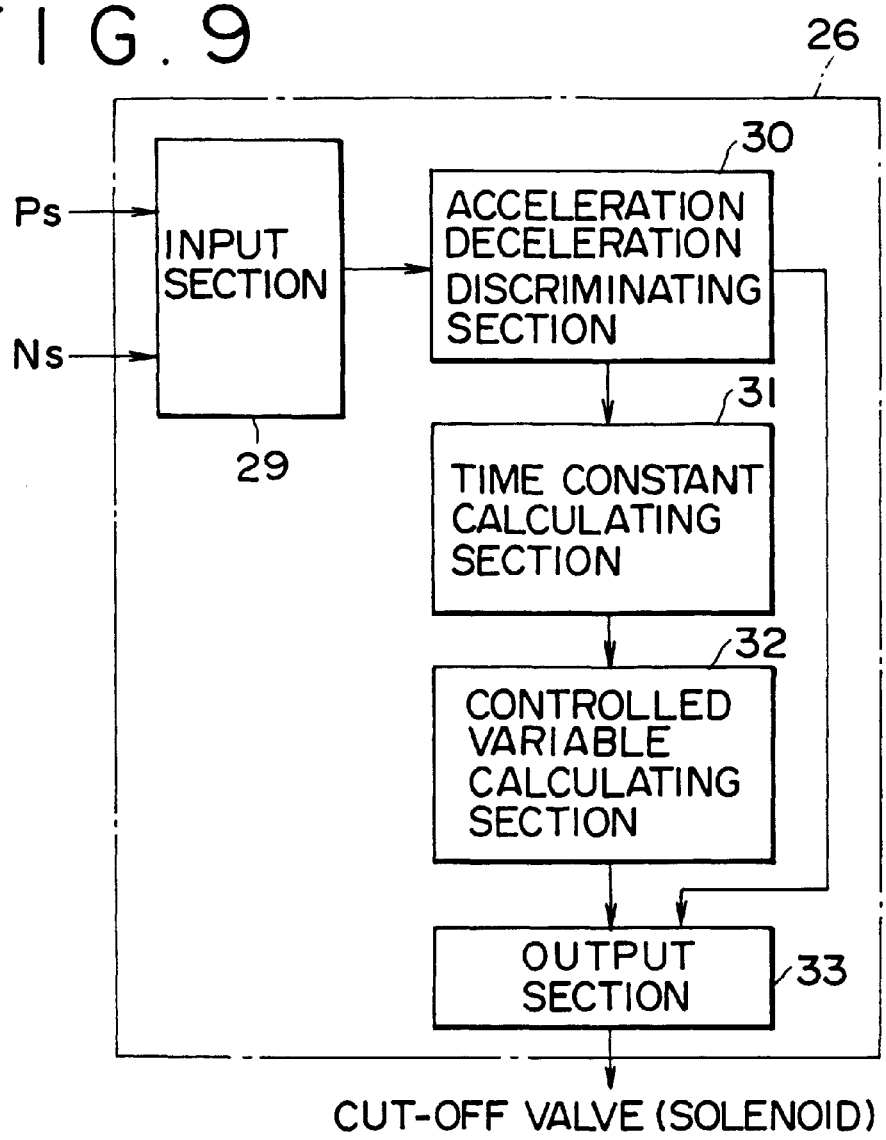
FIG. 9 is a block diagram of a controller used in the control system of the second embodiment.
Figure 10:
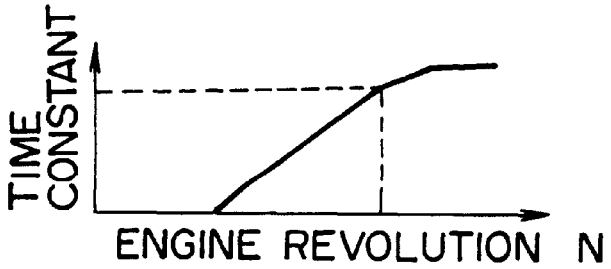
FIG. 10 is a graph showing a relation between the number of revolutions of an engine and time constants both set by the controller in the control system of the second embodiment.

As shown in FIG. 9, the controller 26 comprises an input section 29 to which the sensor signals Ps and Ns are inputted, an acceleration/deceleration discriminating section 30, a time constant calculating section 31, a controlled variable calculating section 32, and an output section 33. In accordance with the pressure sensor Ps the acceleration/deceleration discriminating section 30 judges whether an accelerating operation has been performed or a decelerating operation performed. When it is judged that a decelerating operation has been performed, a control signal proportional to a manipulated variable is outputted from the output section 33. As shown in FIG. 10, the time constant calculating section 31 sets and stores an engine revolution/time constant characteristic so that the time constant of a first order lag is small at a region where the engine revolution N is low and the time constant becomes large at a region where the engine revolution is high, and determines a time constant in accordance with the number of revolutions of the engine detected. The controlled variable calculating section 32 determines by calculation a controlled variable of a first-order lag taking the above time constant into account. Then, a control signal corresponding to the thus-determined controlled variable is provided to the cut-off valve 19 from the output section 33. As a result, the degree of time lag of the cut-off valve 19 for the control valve 14 becomes small when the number of revolutions of the engine is small, and it becomes large when the number of revolutions of the engine is large.

Thus, when the number of revolutions of the engine and the amount of oil discharged from the pump are both small, the cut-off valve 19 operates quickly to its cloing side, so that the rotating pressure is increased rapidly, whereby it is possible to prevent the delay of the acceleration time.

As a delay element of the controller 26 there may be used a rate limiter and a limiting rate of the rate limiter may be changed according to the number of revolutions of the engine.

Figure 11:
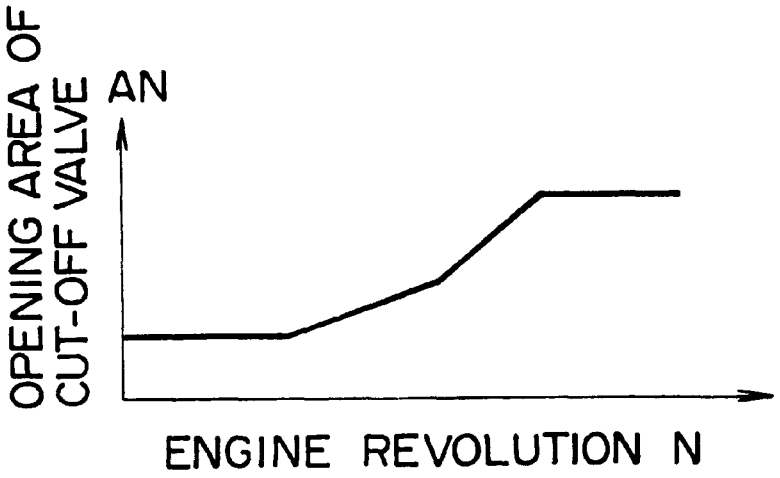
FIG. 11 is a graph showing a relation between the number of revolutions of an engine and a cut-off valve opening area both set in a control system according to the third embodiment of the present invention.
Figure 12:
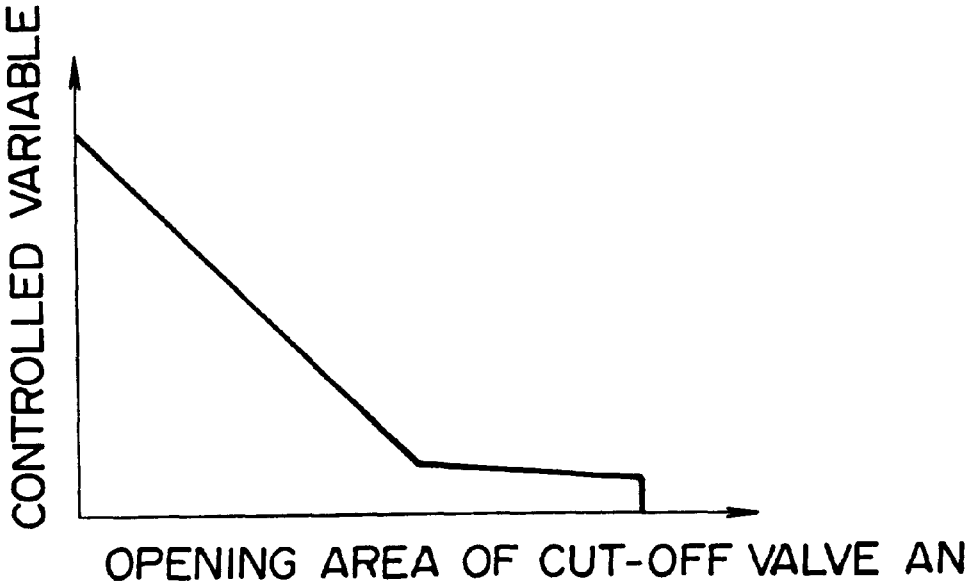
FIG. 12 is a graph showing a relation between the cut-off valve opening area and a controlled variable in the third embodiment of the present invention.

Third Embodiment (FIGS. 11, 12)

In order to achieve the same object as that in the above second embodiment, the opening area characteristic of the cut-off valve 19 is varied according to the number of revolutions N of the engine as shown in FIGS. 11 and 12. To be more specific, in order that almost the same time-rotating speed relation may be obtained at the same lever position irrespective of the number of revolutions of the engine, the relation (FIG. 11) between the engine revolution N and the cut-off valve opening area AN, as well as the relation (FIG. 12) between the cut-off valve opening area AN and a controlled variable for the cut-off valve, are set such that the cut-off valve opening area is large at a high revolution region and is small at a low revolution region. Then, on the basis of the manipulated variable of the lever detected and the number of revolutions of the engine detected there are calculated the cut-off valve opening area AN and further a controlled variable for the cut-off valve to attain the opening area AN. With this controlled variable, the cut-off valve 19 is controlled.

Alternatively, in combination of the second and third embodiments, the time constant of a first-order lag and the cut-off valve opening area may be made variable according to the number of revolutions of the engine.

Figure 13:
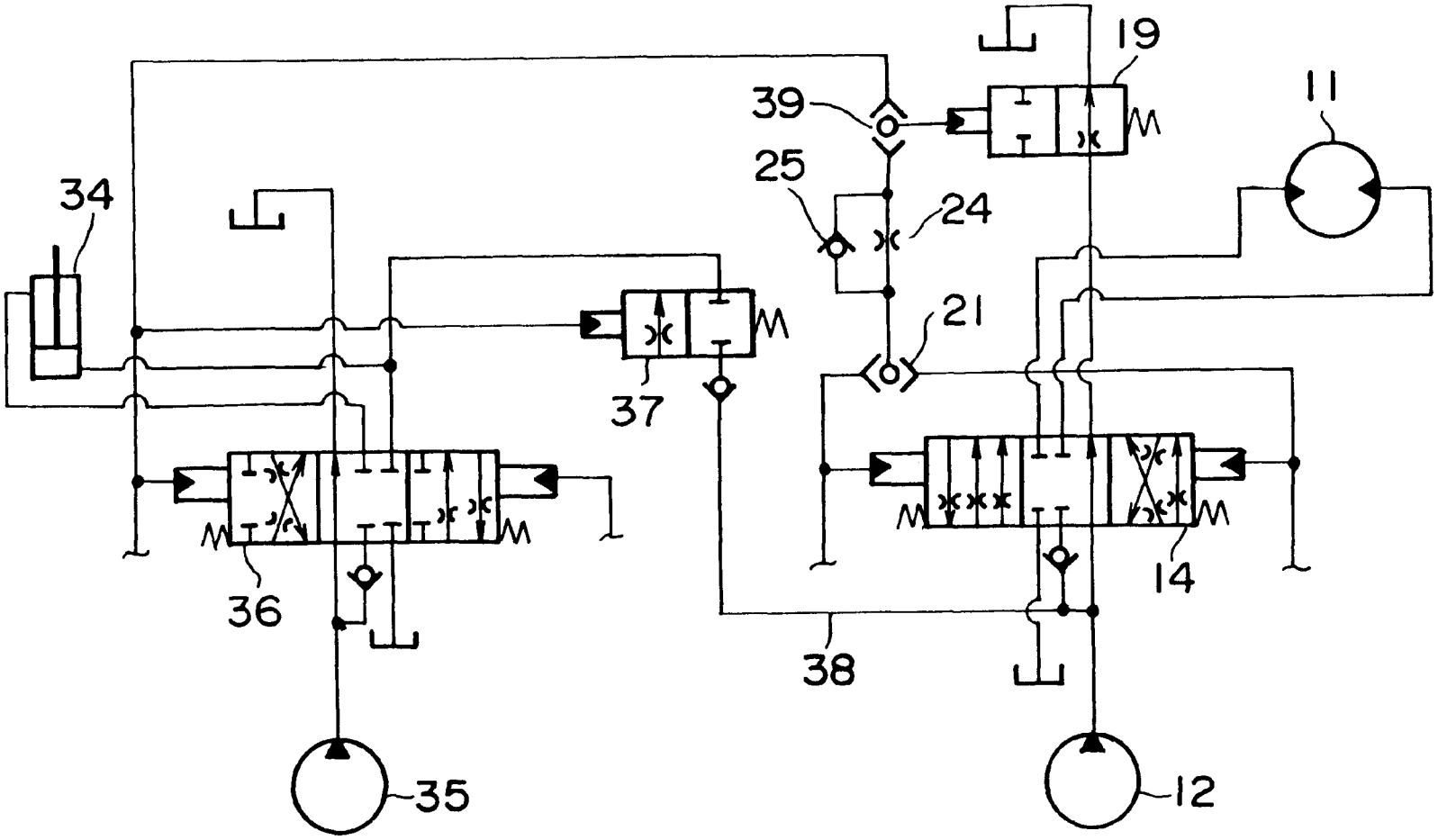
FIG. 13 is a circuit diagram of a control system according to the fourth embodiment of the present invention.

Fourth Embodiment (FIG. 13)

In a conventional hydraulic circuit used in a hydraulic excavator or a hydraulic crane, it is not that one actuator is driven by a single pump, but in many cases there is adopted a construction in which for an actuator requiring a large flow rate (high speed) the oil discharged from a pump for the actuator and the oil discharged from another pump are joined together and supplied to the actuator.

In this case, a portion of the oil discharged from the pump is bled off by means of the cut-off valve 19 except the case where the control valve 14 is in a state of full stroke, so that at the time of confluence the flow rate decreases by an amount corresponding to the amount bled off as above. In the fourth embodiment, to avoid this inconvenience, there is adopted a circuit configuration using a confluent system in which the cut-off valve 19 is cloed upon operation for joining oils to ensure a predetermined certain amount of joined oil.

In FIG. 13, the numeral 34 denotes a hydraulic cylinder which is an actuator of a large flow rate, the numeral 35 denotes a hydraulic pump acting as a main oil pressure source for the cylinder 34, the numeral 36 denotes a control valve for controlling the cylinder (hereinafter the first pump and the first control valve will be referred to for a rotating motor circuit, and the second pump and the second control valve will be referred to for a cylinder circuit), and the numeral 37 denotes a confluent valve. A confluent line 38 is connected to a discharge line from a first pump 12. When a second control valve 36 is operated to its extension side, the oil discharged from the first pump 12 joins the oil discharged from the second pump 35 through the confluent line 38 and the confluent valve 37, and the thus-joined oil is fed to the hydraulic cylinder 34. At this time, a pilot pressure of the second control valve 36 is introduced into the cut-off valve 19 through the shuttle valve 39 to operate the cut-off valve 19 in its cloing direction.

By so doing, the bleed-off line of the rotating motor circuit is closed, so that the oil discharged from the first pump 12 can be jointed without waste to the hydraulic cylinder circuit side. When the control valves 14 and 36 are operated simultaneously, the oil discharged from the first pump 12 is distributed to both circuits. At the time of this simultaneous operation the delaying action of the cut-off valve 19 is lost, but since the amount of oil fed to the rotating motor 11 is decreased by the above flow distributing action, there is obtained a state similar to the exhibited state of the delaying action of the cut-off valve 19. Thus, the present invention can be applied without any trouble even to the circuit configuration adopting the above confluent system.

Fifth Embodiment (FIGS. 14~21)

Figure 14:
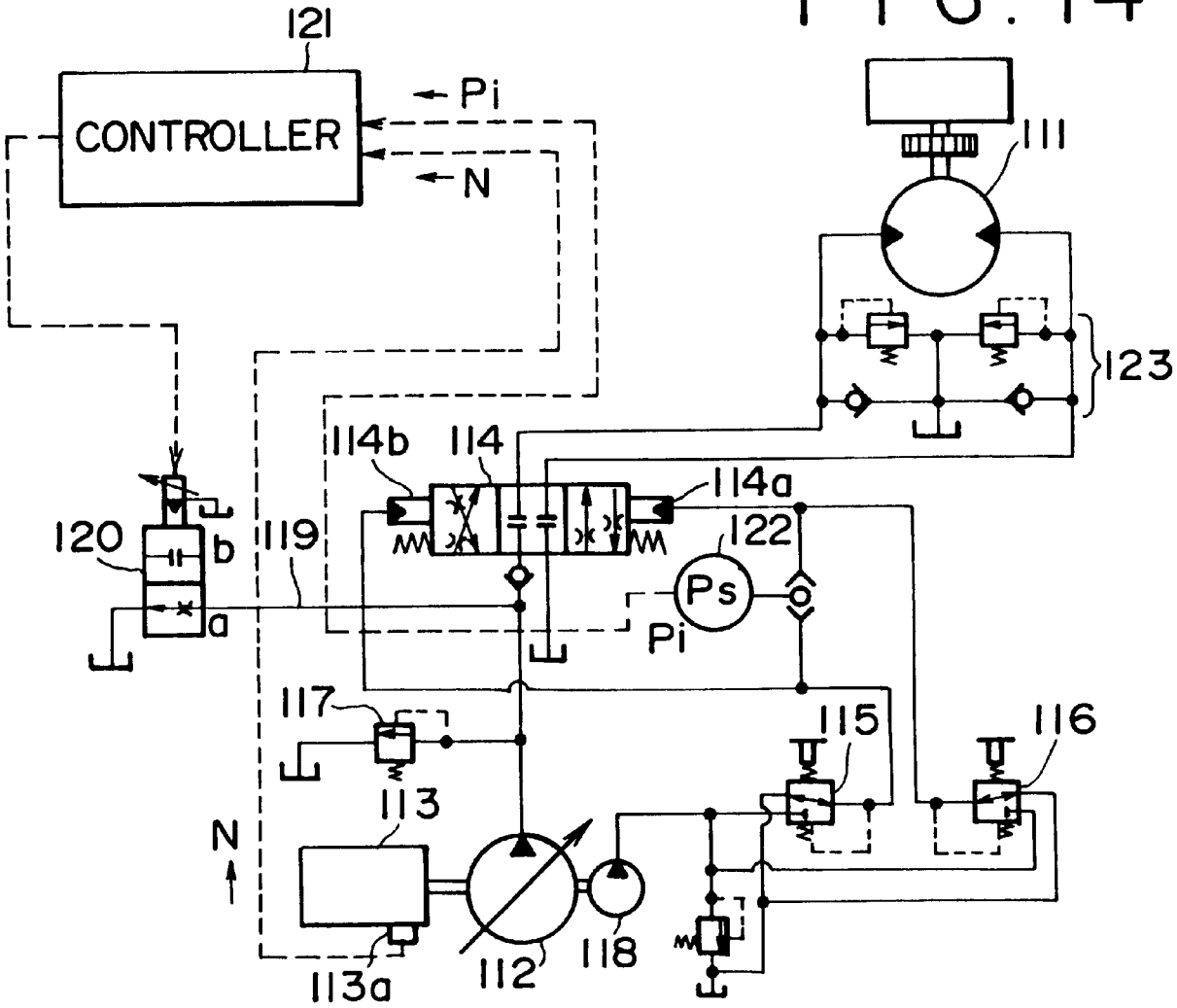
FIG. 14 is a circuit diagram of a control system according to the fifth embodiment of the present invention.

In FIG. 14, the numeral 111 denotes a rotating motor as a hydraulic motor, the numeral 112 denotes a hydraulic pump, the numeral 113 denotes an engine as a prime mover for driving the hydraulic pump 112, the numeral 114 denotes a control valve of a hydraulic pilot change-over type for controlling the operation of the rotating motor 111, the numerals 115 and 116 denote pilot valves each operated by an operating lever, the numeral 117 denotes a relief valve, and the numeral 118 denotes an auxiliary hydraulic pump serving as a primary pressure supply source for the pilot valves 115 and 116.

Figure 15:
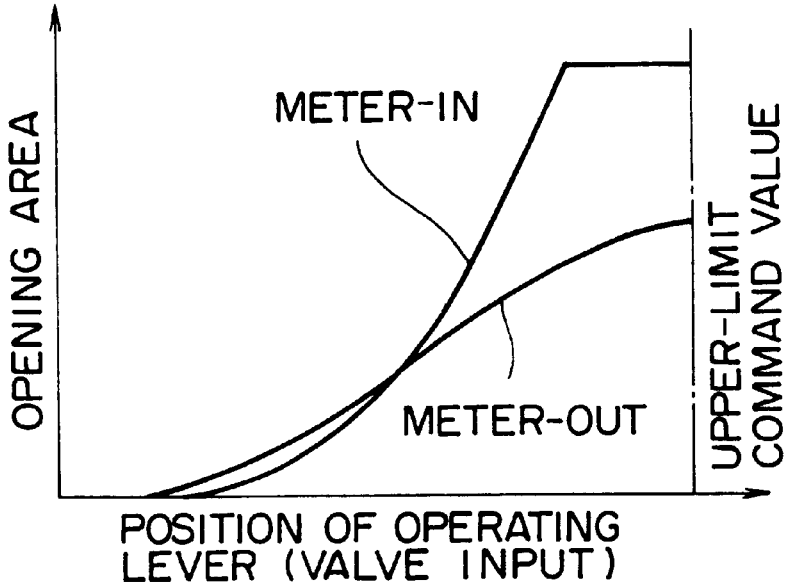
FIG. 15 is a graph showing a relation between the position of a lever and an opening area of a control valve in the control system of the fifth embodiment.

FIG. 15 shows a relation between the lever position of the control valve 114 and the opening area thereof. As shown in the same figure, both meter-in and meter-out opening areas become minimum at a neutral position of the lever. The opening area of the control valve 114 increases as the amount of operation of the operating lever increases.

An unloading valve 120 as a flow control valve is provided in a line 119 which is for bypassing to an oil tank a portion of the flow advancing toward the rotating motor 111 from the hydraulic pump 112. The unloading valve 120 is an electromagnetic proportional valve. The operation of the unloading valve 120 is controlled by a controller 121 as valve control means. Both pilot pressure Pi and engine revolution N are inputted as signals to the controller 121. The pilot pressure Pi is outputted from a pressure sensor 122 which detects the pressure of oil discharged in proportion to the amount of operation of the pilot valves 115 and 116. The engine revolution N is outputted from an engine revolution sensor 113*a*. Numeral 123 denotes a brake circuit. According to this circuit configuration, when the pilot pressure outputted from the pilot valve 116 acts on a pilot port 114*a* located on the right side of the control valve 114, the control valve is operated in an accelerating direction from the neutral position and the motor 111 rotates in the right-hand direction. At this time, the pilot pressure Pi is detected by the pressure sensor 122 and is outputted to the controller 121. In accordance with the pilot pressure Pi the controller 121 controls the opening area of the unloading valve 120. Also in the case where the motor 111 is rotated in the left-hand direction, the opening area of the unloading valve 120 is controlled in accordance with the pilot pressure Pi.

Figure 16:
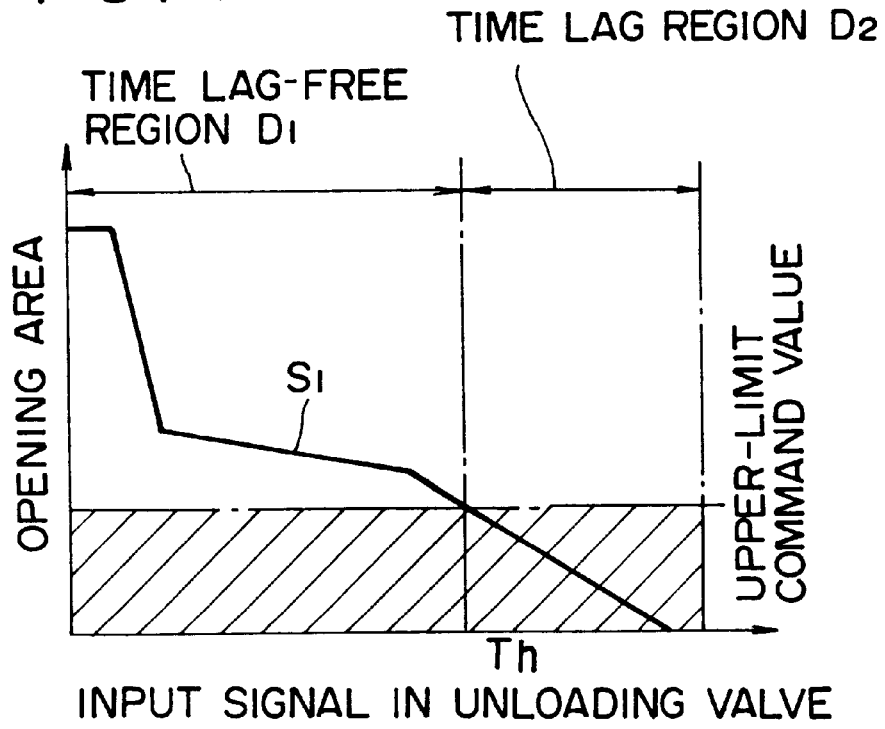
FIG. 16 is a graph showing a relation between an input signal in an unloading valve (a flow control valve) and an opening area of the valve in the control system of the fifth embodiment.

FIG. 16 is a graph showing an opening area characteristic of the unloading valve 120 which is controlled by the controller 121. The unloading valve 120 exhibits a good meter-in characteristic for a static input and is provided with a time lag-free region D1 and a time lag region D2. The "time lag" as referred to herein indicates a first-order lag. The unloading valve 120 has a restrictive position "a", and a fully closed position "b," which are changed over from one to the other in accordance with a command provided from the controller 121. "Th" stands for a threshold value.

In the rotating operation of the conventional hydraulic excavator, if the operating lever is operated up to its maximum limit at a stretch, the bleed-off line is closed, so that the pump pressure and the meter-in pressure rise up to an overloaded relief pressure, thus giving rise to an excessive acceleration. For the purpose of decreasing this excessive acceleration, if the unloading valve is kept open when the amount of operation of the operating lever is maximum, the oil from the pump will pass through the unloading valve and is discharged to the tank, so that it is no longer possible for the hydraulic motor to reach the maximum speed. If the operation of the unloading valve is delayed throughout the whole region, the operation of the same valve is delayed from the beginning relative to the operation of the control valve. Consequently, there arises a delay until rise of a pump pressure necessary for the start of operation, thus resulting in that it is no longer possible to obtain a motion responsive to the operation of the operating lever.

According to this fifth embodiment, as shown in FIG. 16, in connection with an opening area characteristic S1 of the unloading valve 120, there are set a time lag-free region D1 and a time lag region D2 for the spool motion of the control valve 114.

When the amount of operation of the operating lever is small, the time lagers region D1 is selected, so that the actuator operates without a time lag in response to operation of the operating lever. Thus, a slight operation of the operating lever causes the actuator to operate with a high responsivity. On the other hand, upon a sudden operation of the operating lever, the time lag region D2 is selected and hence there is no fear of the unloading valve 120 being cloed suddenly. Therefore, a excessive torque does not occur and there is obtained a smooth acceleration. Thereafter, the unloading valve 120 is closed slowly while accelerating the actuator. When the unloading valve 120 is closed, it is possible to introduce the whole amount of oil discharged from the pump into the actuator, so that it is possible to reach the maximum speed.

Since the time lag is set so as to be cancelled upon return of the operating lever, the unloading valve 120 is cloed in a cloed state of the meter-in passage, thus preventing an abnormal rise of the pump pressure.

Now, with reference to FIG. 17, a description will be given of a method for preventing a hunting phenomenon. In the case where the operator undergoes an excessive acceleration at a small inertia moment of the front attachments, a hunting phenomenon is apt to occur. In connection with a lever operation apt to cause a hunting phenomenon, description is now directed to the case where a sinusoidal input operation (input signal S2) has been performed in the time lag region D2.

Figure 17:
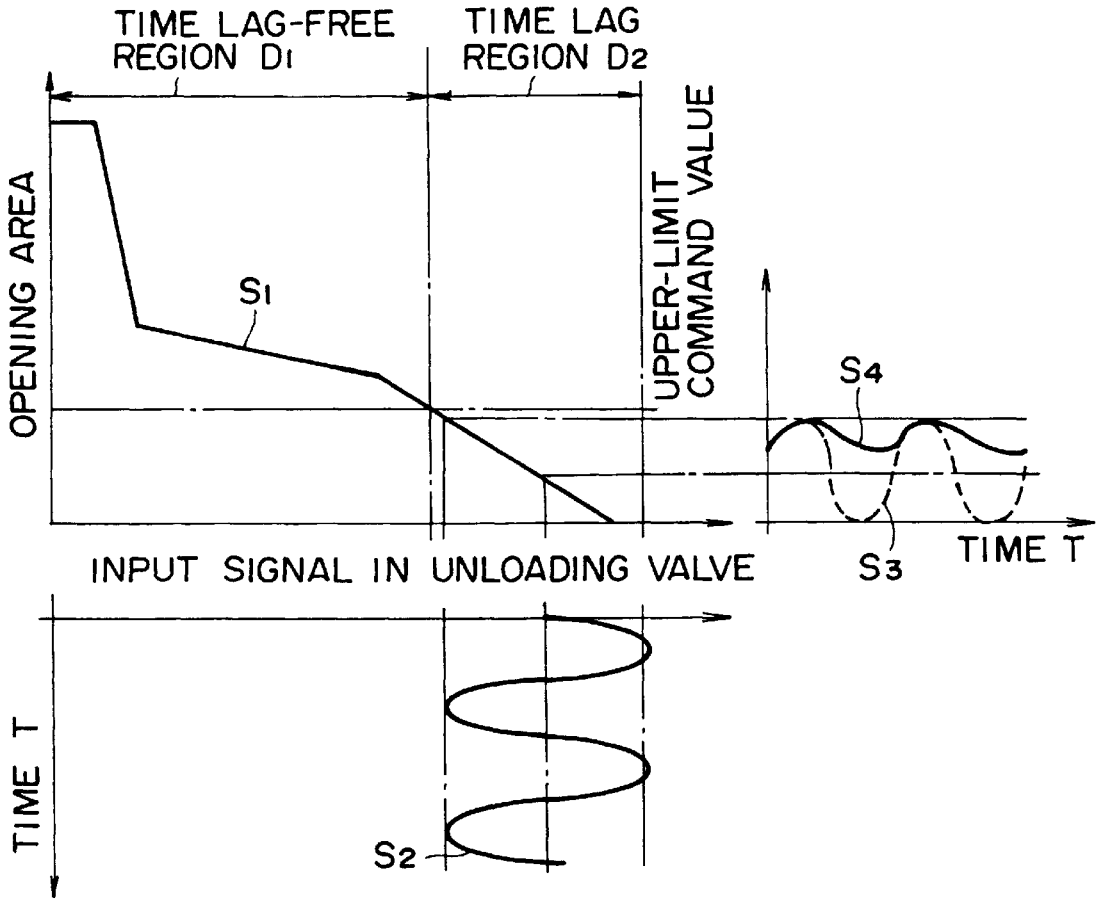
FIG. 17 is a graph explaining a hunting suppressing effect in the control system of the fifth embodiment.

In the time lag region D2, as shown in FIG. 17, the bleed-off opening area is small and the pump pressure (motor meter-in pressure) is in inverse proportion to the square of a change in opening area, so the width of pressure variation becomes large. Therefore, if there occurs a sudden change of the opening area in the time lag region D2, there occurs a sudden acceleration and the hunting phenomenon tends to be continued without attenuation. In this embodiment, however since the unloading valve 120 operates in the time lag region D2 in only the closing direction with a time lag, there is rather a tendency to opening and the change in opening area becomes small. Consequently, there is obtained a response S4 whose amplitude is extremely small as compared with a response S3 (indicated with a broken line in FIG. 17) obtained in the absence of a time lag. Thus, in the region where the opening area of the unloading valve 120 is small and it is easy to increase the pump pressure, there does not occur an excessive acceleration and the hunting phenomenon is suppressed.

In the fifth embodiment, moreover, by detecting the number of revolutions of the engine 113 with use of the revolution sensor 113*a*, a first-order lag which is a delay element of the unloading valve 120 can be changed according to the number of revolutions, N, of the engine.

Where the maximum pump flow rate is proportional to the engine revolution, it is possible to grasp the discharge flow rate of the pump on the basis of the engine revolution. The operator adjusts the engine revolution N between low and high idling conditions as necessary. When the operator adjusts the engine revolution N to a low idling condition and the flow rate in the pump has decreased thereby, the response sensitivity of the pump pressure to a change in the bleed-off opening becomes lower. Consequently, the rotational acceleration drops and the rotating pressure seldom reaches the relief pressure. On the other hand, when the operator adjusts the engine revolution N to a high idling condition, it is impossible to start rotation unless the operating lever is operated deep. Further, in the case where bleed-off takes place in the time lag region D2 of the unloading valve 120, acceleration proceeds with a time lag. Of course, these points are not desirable.

The controller 121 used in this fifth embodiment can make small or zero the "time constant of a first-order lag" used in controlling the unloading valve 120, whereby the spool of the control valve 114 and that of the unloading valve 120 can move at substantially the same speed, thus permitting omission of the time lag region D2 shown in FIG. 16. Consequently, the position of the operating lever at the start of movement is sometimes rather deep, but there no longer is any time lag of operation.

In place of the control using the time constant of a first-order lag there may be used a rate limiter as a delay element for the controller 121, and the limiting rate of the rate limiter may be varied according to the number of revolutions, N, of the engine.

Figure 18:
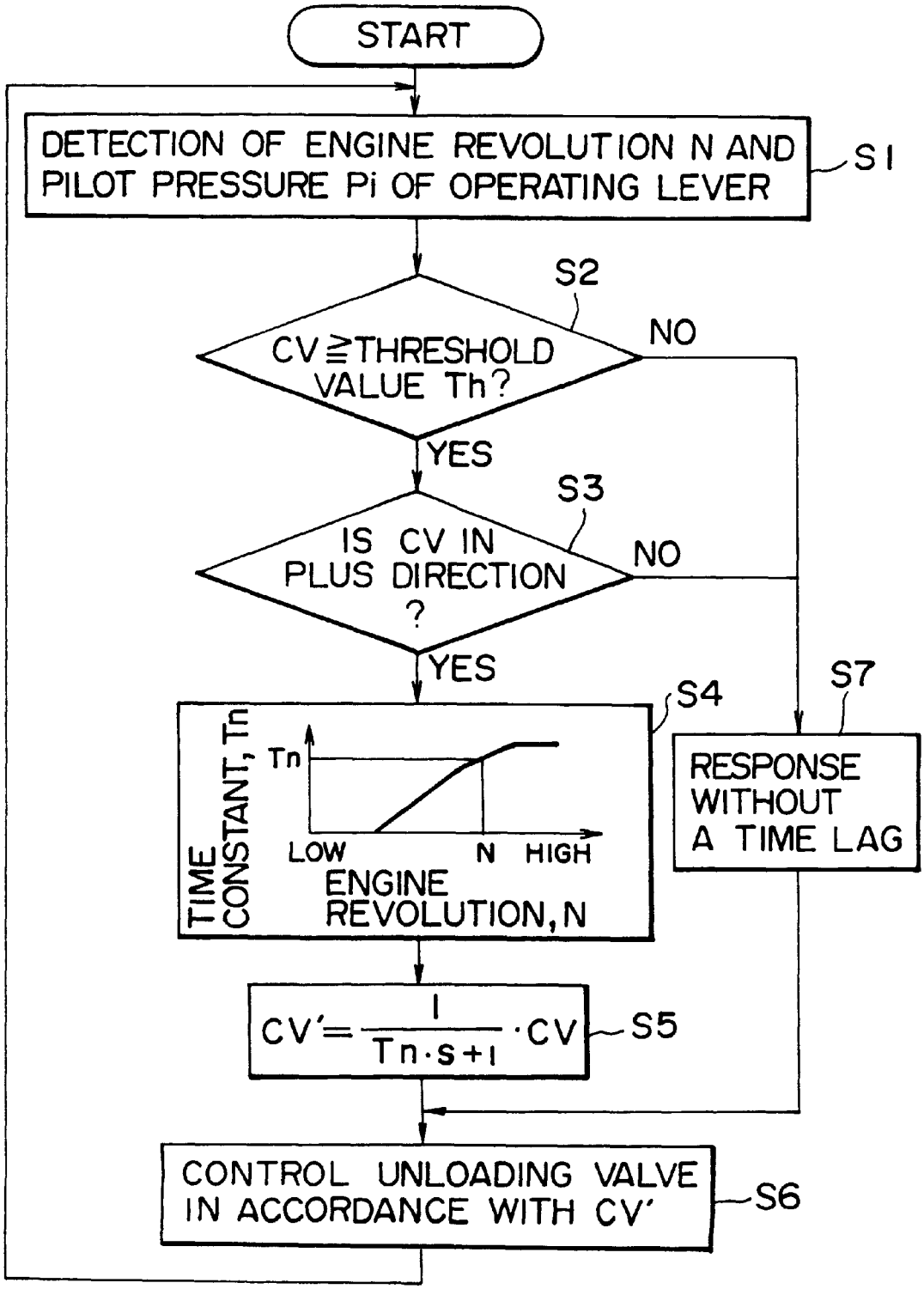
FIG. 18 is a flow chart explaining the operation of the control system of the fifth embodiment.

The flow chart of FIG. 18 shows a control flow for making a control to change the time constant of a first-order lag.

In step S1, the number of revolutions, N, of the engine and the pilot pressure P1 of the operating lever are detected by the engine revolution sensor 113*a* and the pressure sensor 122, respectively. The results of the detection are inputted to the controller 121. The controller 121 outputs a command value Cv for the control valve 114 in accordance with the pilot pressure Pi. Then, in step S2, a judgment is made as to whether the command value Cv is not smaller than the threshold valve Th. If the answer is affirmative, then in step S3, it is judged whether the command value Cv is in the plus direction or not. The plus direction of the command value Cv means a direction in which the input signal in the unloading valve 120 becomes larger. If the answer is affirmative in step S3, a first-order lag constant proportional to the engine revolution N is calculated in step S4. The result of this calculation is set as a command value Cv' for the unloading valve in step S5. Lastly, in step S6, the unloading valve 120 is controlled in accordance with the command value Cv'. If the answer is negative in step S2, a time lag-free response is set in step S7.

Even by changing the range of the time lag region D2 according to idling conditions there can be obtained the same effect as in changing the first-order lag constant. More specifically, when the engine revolution N is low, it suffices for the time lag region D2 to be of a small range because there is no fear of occurrence of an excessive acceleration. At a low engine revolution, therefore, it is possible to set large the threshold value Th. That is, it is possible to either narrow the time lag region D2 or exclude it.

Figure 19:
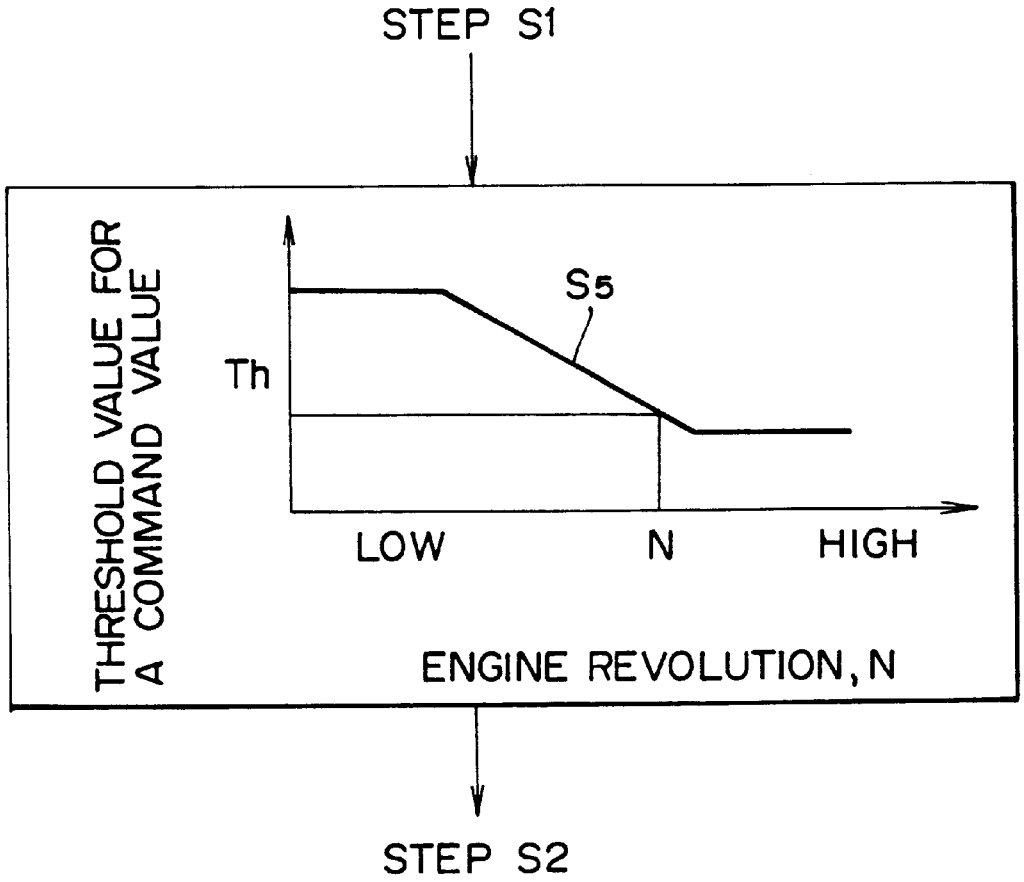
FIG. 19 is a flow chart explaining a modification of operation in the control system of the fifth embodiment.

In this case, such a threshold value characteristic processing as shown in FIG. 19 may be added between the steps S1 and S2 shown in FIG. 18. More particularly, the threshold value Th corresponding to the engine revolution N is determined on the basis of such a threshold value Th as drops like line S5 in FIG. 19, and the threshold value Th thus obtained is set as the threshold value Th in step S2 in FIG. 18.

In the case where it is possible to control the amount of oil discharged from the pump, the flow rate of oil discharged from the oil can be corrected in response to a decrease in the number of revolutions of the engine, so even with only the foregoing correction of the time constant it is possible to effect a flow control to a considerable extent.

If the pump does not have such a correcting function, the same purpose as above can be attained by adjusting the opening area characteristic of the unloading valve 120 on the basis of the engine revolution N to make correction for the decrease of the pump flow rate. To be more specific, by making the opening area of the unloading valve 120 smaller than the standard opening area so as to optimize the opening area of the valve, it is possible to correct the position of the operating lever at the beginning of rotation, and thus a satisfactory flow control can be made even in a low idling condition. In more particular terms, if the control valve 114 is set to make matching in a high idling condition, the command for the unloading valve 120 is corrected so that the position of the operating lever at the beginning of motion is relatively shallow in a low idling condition.

Figure 20:
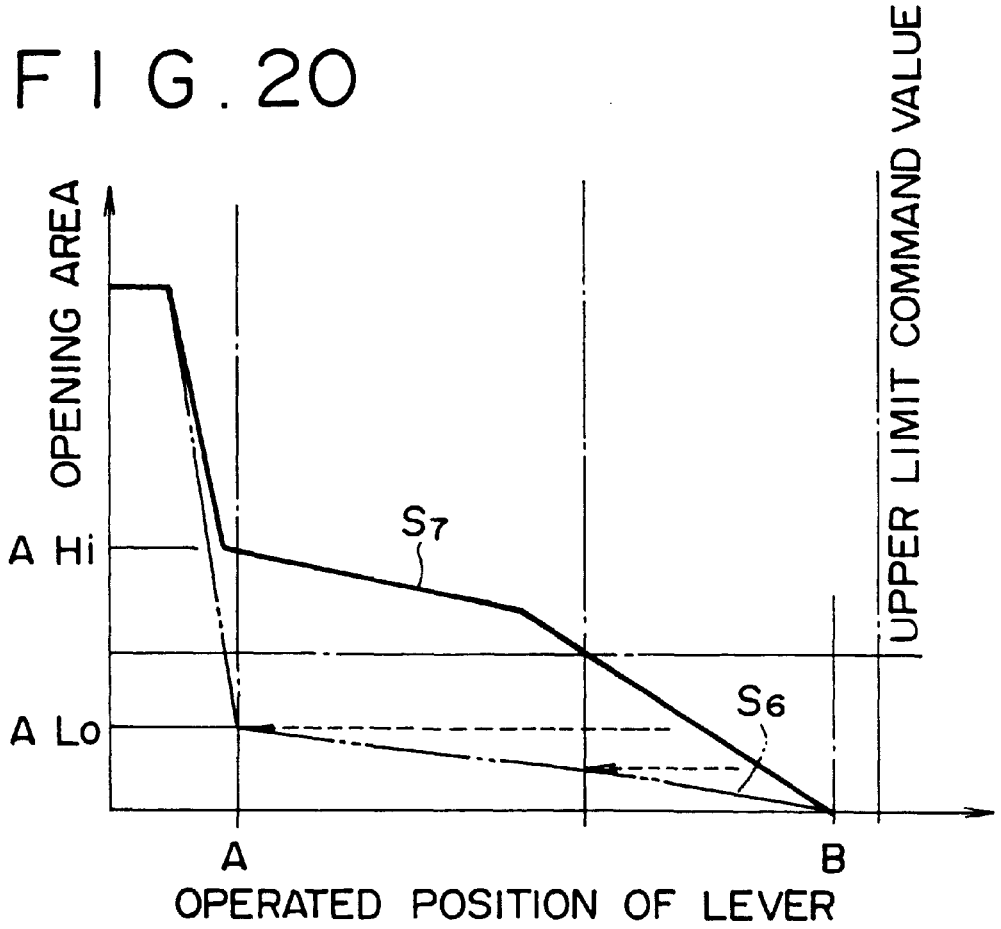
FIGS. 20 and 21 are graphs explaining correction of the unloading valve according to changes in the number of revolutions of an engine in the control system of the fifth embodiment.
Figure 21:
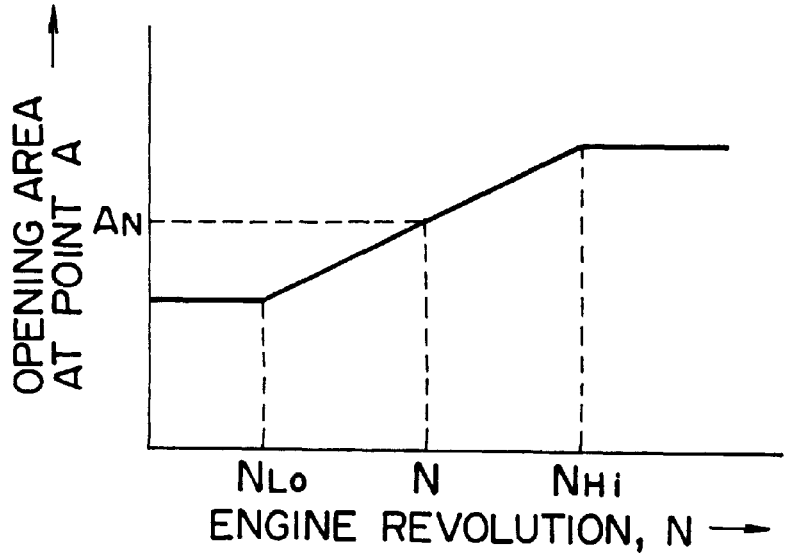
Figure 22:
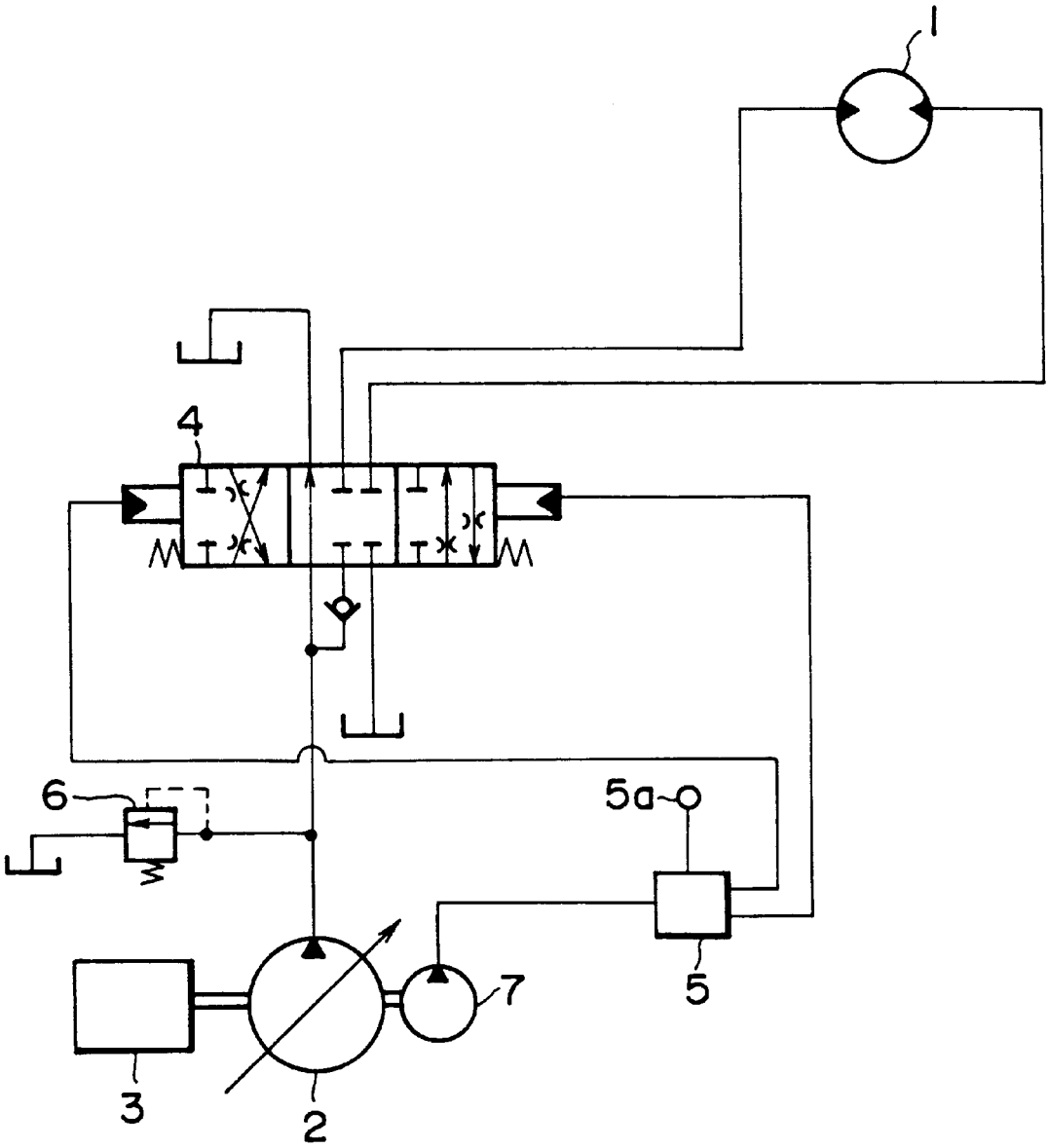
FIG. 22 PRIOR ART
FIG. 22 is a circuit diagram according to the prior art.

This correction is shown in FIGS. 20 and 21. In FIG. 20, the line S6 represents an opening characteristic of the unloading valve which is commanded in a low idling condition, while the line S7 represents an opening characteristic which is commanded in a high idling condition. Optimum opening areas AN corresponding to target engine revolutions, ranging from an opening area AHi at start-up point A in a standard state during high idling up to an opening area ALo which permits generation of a starting pressure even at the lowest engine revolution are stored in an internal ROM of the controller 121 continuously.

When the position of the operating lever and the number of revolutions, N, of the engine are detected, the controller 121 determines an opening area AN corresponding to the engine revolution N on the basis of the characteristic diagram of FIG. 21 showing the engine revolution vs. opening area. Then, there is prepared such a control valve command map as shown in FIG. 20 which corresponds to the thus-determined opening area AN. The controller 121 determines a command value Cv for the unloading valve corresponding to the position of the operating lever and outputs the result to the unloading valve 120. Thus, the opening area corresponding to the operating lever position can be made small in proportion to the decrease of the engine revolution N.

Although in the first to fourth embodiments described above, the cut-off valve 19 is operated without a time lag in its opening direction, there may be adopted a construction in which the cut-off valve is operated with a time lag in its opening direction if necessary.

Although in the above embodiments the present invention is applied to a rotating motor, the invention is also applicable to a traveling motor in a hydraulic excavator or a hydraulic crane.

We claim:

1. A control system for a hydraulic motor, comprising:

the hydraulic motor;

a hydraulic pump for supplying an oil pressure to said hydraulic motor;

a control valve for controlling an operation of said hydraulic motor in accordance with a command provided from operating means;

a flow control valve disposed in a line for bypassing to a tank a portion of an oil flow advancing toward the hydraulic motor; and valve control means for controlling said flow control valve, said valve control means operating said flow control valve with a time lag for a motion of said control valve to prevent a sudden accelerating operation of the hydraulic motor wherein said flow control valve is disposed in a bleed-off line which bypasses to the tank a portion of an oil flow advancing toward the hydraulic motor; and said valve control means, interlockedly with operation of said control valve, controls said flow control valve so as to give a minimum opening area at a full stroke of the control valve and a maximum opening area in a neutral state of the control valve, and in a closing direction in which the opening are of the flow control valve becomes small the valve control means operates the flow control valve with a time lag for a motion of the control valve.

2. A control system for a hydraulic motor according to claim 1, wherein:

in an opening direction in which the opening area of said flow control valve becomes large, said valve control means operates the flow control valve without a time lag for a motion of said control valve.

3. A control system for a hydraulic motor according to claim 1, further comprising:

a confluent line for joining the oil discharged from said hydraulic pump to oil supplied from another hydraulic pump to another hydraulic actuator.

4. A control system for a hydraulic motor according to claim 3, wherein:

at the time when the oils are joined together, said valve control means operates said flow control valve in the cloing direction without a time lag.

5. A control system for a hydraulic motor according to claim 1, wherein:

said control valve and said flow control valve are hydraulic pilot type valves; and said valve control means has a restrictor provided in a pilot circuit for delaying the supply of a pilot pressure to a pilot port of said flow control valve, said pilot circuit connecting a pilot line of the control valve and the pilot port of the flow control valve with each other.

6. A control system for a hydraulic motor according to claim 5, wherein:

said valve control means has a check valve in parallel with said restrictor, said check valve permitting the oil to flow only in a direction to relieve the pilot pressure from the pilot port.

7. A control system for a hydraulic motor according to claim 1, wherein:

said flow control valve is an electromagnetic proportional valve; and said valve control means provides an output to an electromagnetic operation part of said flow control valve with a time lag for a motion of said control valve in the cloing direction in which the opening area of the flow control valve becomes small.

8. A control system for a hydraulic motor according to claim 7, wherein:

said valve control means provides an output to the electromagnetic operation part of said flow control valve without a time lag for a motion of said control valve in the opening direction in which the opening area of the flow control valve becomes large.

9. A control system for a hydraulic motor according to claim 7, wherein:

said valve control means makes the degree of time lag variable according to the number of revolutions of an engine as a drive source for the hydraulic pump.

10. A control system for a hydraulic motor according to claim 7, wherein:

said valve control means makes an opening area characteristic of said flow control valve variable according to the number of revolutions of an engine as a drive source for the hydraulic pump.

11. A control system for a hydraulic motor, comprising:

the hydraulic motor;

a hydraulic pump for supplying an oil pressure to said hydraulic motor;

a control valve for controlling an operation of said hydraulic motor in accordance with a command provided from operating means;

a flow control valve disposed in a line for bypassing to a tank a portion of an oil flow advancing toward the hydraulic motor;

valve control means for controlling said flow control valve, said valve control means operating said flow control valve with a time lag for a motion of said control valve to prevent a sudden accelerating operation of the hydraulic motor; and said valve control means operates said flow control valve without a time lag for a motion of said control valve in the case where the amount of operation of said operating means is small, and operates the flow control valve with a time lag for the motion of the control valve in the case where the amount of operation of the operating means is large.

12. A control system for a hydraulic motor according to claim 11, wherein:

said flow control valve is disposed in a bleed-off line for bypassing to the tank a portion of the oil flow advancing toward the hydraulic motor at an upstream position relative to said control valve.

13. A control system for a hydraulic motor according to claim 11, wherein:

said valve control means makes the degree of time lag variable according to the number of revolutions of an engine as a drive source for the hydraulic pump.

14. A control system for a hydraulic motor according to claim 11, wherein:

the range in which said flow control valve is operated without a time lag for the motion of said control valve is made variable by said valve control means according to the number of revolutions of the engine as a drive source for the hydraulic pump.

* * * * *